US005928847A

United States Patent [19]

Visconte et al.

[11] Patent Number: 5,928,847

[45] Date of Patent: Jul. 27, 1999

[54] PHOTOGRAPHIC ELEMENT HAVING ULTRATHIN TABULAR GRAINS

[75] Inventors: Gary W. Visconte; Alfred B. Fant, both of Rochester; Yongcai Wang, Penfield; Ronald G. Olsen, Fairport, all of N.Y.

[73] Assignee: Eastman Kodak Company, Rochester, N.Y.

[21] Appl. No.: 09/039,047

[22] Filed: Mar. 13, 1998

[51] Int. Cl.[6] ..... G03C 1/30; G03C 1/46; G03C 7/392; G03C 7/26

[52] U.S. Cl. ..... 430/507; 430/503; 430/505; 430/568; 430/621; 430/622

[58] Field of Search ..... 430/502, 503, 430/505, 621, 509, 622, 507

[56] References Cited

U.S. PATENT DOCUMENTS

| | | | |
|---|---|---|---|
| 4,748,106 | 5/1988 | Hayashi | 430/503 |
| 5,219,715 | 6/1993 | Sowinski et al. | 430/505 |
| 5,250,403 | 10/1993 | Antoniades et al. | 430/505 |

FOREIGN PATENT DOCUMENTS 0 629 909 12/1994 European Pat. Off. .

OTHER PUBLICATIONS

Research Disclosure, May 1985, 25330, pp. 237–240.

*Primary Examiner*—Richard L. Schilling
*Attorney, Agent, or Firm*—Carl F. Ruoff

[57] ABSTRACT

This invention contemplates a multilayer, multicolor photographic element comprising a support, a plurality of dye-forming hydrophilic colloid containing silver halide emulsion layers which are spectrally sensitized to different regions of the visible spectrum including at least one blue-sensitive emulsion layer, a green-sensitive emulsion layer, and a red-sensitive emulsion layer. Each of the silver halide emulsion layers includes imaging silver having at least 25 weight percent ultrathin tabular grains having a thickness of less than 0.07 microns. One of the silver halide emulsion layers is a topmost silver halide emulsion layer having a water swell percentage which is greater than any other light-sensitive emulsion layer.

9 Claims, No Drawings

PHOTOGRAPHIC ELEMENT HAVING ULTRATHIN TABULAR GRAINS

CROSS REFERENCE TO RELATED APPLICATIONS

This application relates to commonly assigned copending application Ser. No. 07/034,402, filed simultaneously herewith and hereby incorporated by reference for all that it discloses.

FIELD OF THE INVENTION

This invention relates to a multilayer, multicolor photographic element that contains a hardener with improved sensitometric properties.

BACKGROUND OF THE INVENTION

It is conventional practice to form photographic elements by forming on a support one or more photographically active layers. Typically these photographically active layers contain silver halide dispersed in a hydrophilic colloid, such as gelatin, to form an emulsion. In multi-layer photographic elements used in color photography there are at least three selectively sensitive color-forming units each made up of one or more emulsion layers coated on one side of a photographic support, such as film or paper. The color forming units are typically rendered variously responsive to the red, green and blue regions of the spectrum. The blue-sensitive color-forming unit typically contains a yellow coupler, the green-sensitive color forming unit a magenta coupler and the red-sensitive color forming unit a cyan coupler. In an alternative form color couplers are not initially present in the photographic element, but are introduced during processing after an image forming exposure. Hydrophilic colloid subbing layers, interlayers and protective layers are also typically present. The blue-sensitive color forming unit forms preferably the outermost unit, and a yellow filter layer normally overlies the green and the red sensitive color forming units to protect them against residual blue light not absorbed in the blue-sensitive color forming unit. Multi-layer photographic elements used in color photography of this general type and processes for their preparation are well known in the art.

Over the past several years, photographic manufacturers have focused on ways of conserving a valuable silver resource by lowering the coated weight of light-sensitive silver halide in photographic elements (S. Honjo, *J. Imaging Tech.,* 15, 182 (1989)). However, it has been difficult to obtain a low silver-containing light sensitive material that does not compromise important image qualities like sharpness, speed, or graininess (European Patent Publication 0 629 909).

In Antoniades et al., U.S. Pat. No. 5,250,403, there are described photographic elements that use ultrathin tabular grain emulsions (less than 0.07 microns thick) in the topmost layer that provide distinct improvements in the specularity of the transmitted light and, thereby, an improvement in the acutance of underlying layers. In Sowinski et al., U.S. Pat. No. 5,219,715, there are described photographic elements having low coverage of certain tabular grain silver halide emulsions. However, the use of such ultrathin tabular grain emulsions is reported by one of the inventors in the above Sowinski patent to lead to significant speed losses (A. E. Bohan, G. L. House, *J. Imaging Science and Tech.,* 38, 32 (1994)) because of the high front surface reflectance of these thin emulsions (*Research Disclosure* 25330, May, 1985).

Thus, when these ultrathin tabular grain emulsions are employed in so-called "successive layer" structures that are conventionally employed in color photographic materials, such as for example when a support has provided successively thereon a red-sensitive layer, a green sensitive layer, and a blue sensitive layer, either a loss in speed or a diminution in another important photographic property would be expected to result.

It is also conventional practice to incorporate into photographic hydrophilic colloid layers addenda, referred to as hardeners, having as their purpose the reduction or elimination of the susceptibility of such colloid layers to wet abrasion, swelling in aqueous solutions and softening at elevated temperatures. Wet abrasion, swelling and softening are of primary concern during processing, especially in those instances where it is desired to accelerate processing by resort to elevated temperatures. Gelatin containing layers that are not treated with a hardening agent generally have poorer water resistance, heat resistance, and wet abrasion resistance.

After exposure to light, the photographic element is processed chemically to reveal a usable image. The chemical processing entails two fundamental steps. The first is the treatment of the exposed silver halide with a color developer wherein some or all of the silver halide is reduced to metallic silver while an organic dye is formed from the oxidized color developer. The second is the removal of the silver metal thus formed and of any residual silver halide by the desilvering steps of (1) bleaching, wherein the developed silver is oxidized to silver salts; and (2) fixing, wherein the silver salts are dissolved and removed from the photographic material. The bleaching and fixing steps may be performed sequentially or as a single step. The overall rate of development is influenced by swelling of the gelatin layer and diffusion rate of different chemical species into and out of the swollen emulsion layers. The diffusion coefficient value and emulsion layer swelling thickness increases with processing temperature and decreases with increasing hardness of the gelatin. When emulsion layer is hardened, the decrease in diffusivity is partially offset by the decrease in the swelling thickness and hence the decrease in diffusion pathlength. Therefore under given processing conditions, there is an optimum emulsion layer hardness for achieving desirable optical density or contrast or photographic speed.

The object of this invention is to provide a multilayer, multicolor photographic element where the imaging layers comprise a significant portion of silver halide tabular grains having a thickness less than 0.07 microns. The photographic element has well-balanced water swelling values in each dye-forming hydrophilic colloid containing silver halide emulsion layer and exhibits excellent photographic speed.

SUMMARY OF THE INVENTION

This invention contemplates a multilayer, multicolor photographic element comprising a support, a plurality of dye-forming hydrophilic colloid containing silver halide emulsion layers which are spectrally sensitized to different regions of the visible spectrum including at least one blue-sensitive emulsion layer, a green-sensitive emulsion layer, and a red-sensitive emulsion layer. Each of the silver halide emulsion layers includes imaging silver having at least 25 weight percent ultrathin tabular grains having a thickness of less than 0.07 microns. One of the silver halide emulsion layers is a topmost silver halide emulsion layer having a water swell percentage which is greater than any other light-sensitive emulsion layer.

DESCRIPTION OF PREFERRED EMBODIMENTS

The multilayer, multicolor photographic elements of this invention typically contain dye image-forming layers sensitive to each of the thee primary regions of the visible spectrum. Each layer can comprise a single emulsion layer or of multiple emulsion layers sensitive to a region of the spectrum. The layers of the element can be arranged in various orders as known in the art. A typical multicolor photographic element comprises a support bearing a cyan dye image-forming layer comprising at least one red-sensitive silver halide emulsion layer having associated therewith at least one cyan dye-forming coupler, a magenta dye image-forming layer comprising at least one green-sensitive silver halide emulsion layer having associated therewith at least one magenta dye-forming coupler, and a yellow dye image-forming layer comprising at least one blue-sensitive silver halide emulsion layer having associated therewith at least one yellow dye-forming coupler.

The element typically contains additional layers, such as filter layers, interlayers, overcoat layers, subbing layers, and the like. All of these can be coated on a support which can be transparent or reflective. Photographic elements protected in accordance with the present invention may also include a transparent magnetic recording layer such as a layer containing magnetic particles. The total dry thickness of the all hydrophilic colloid layers of the color photographic material depends on the silver halide emulsion contained, the coupler, the oily agent, the additive, etc., and a preferable film thickness of all the emulsion layers varies from 5 to 35 $\mu$m, preferably from 10 to 30 $\mu$m.

The multilayer, multicolor photographic elements of this invention can vary greatly in regard to the type of the support. Typical supports include cellulose nitrate film, cellulose acetate film, poly(vinyl acetal) film, polystyrene including syndiotactic polystyrene film, polycarbonate film, poly(ethylene terephthalate) film, poly(ethylene naphthalate) film, glass, metal plate, paper, polymer coated paper, and the like. The support may be annealed.

In one of the preferred embodiments, the layer constitution of the multilayer, multicolor photographic elements according to the present invention comprises, coated successively from the support, a colloidal silver antihalation layer, a cyan dye image-forming layer, an interlayer, a magenta dye image-forming layer, an interlayer, a colloidal silver yellow filter layer, a yellow dye image-forming layer, an ultraviolet ray absorbing layer, and a protective overcoat layer.

In the following discussion of layer structures, the red sensitive layer includes an antihalation layer, a cyan dye image-forming layer which comprises a plurality of low speed and high speed layers, and an interlayer; the green sensitive layer includes a magenta dye image forming layer which comprises a plurality of low speed and high speed layers, and a yellow filter layer, the blue sensitive layer includes a yellow dye image-forming layer which comprises a plurality of low speed and high speed layers, an ultraviolet ray absorbing layer, and a protective overcoat layer. The layer constitution of the multilayer, multicolor photographic elements then comprises, coated successively from the support, the red sensitive layer, the green sensitive layer, and the blue sensitive layer. The blue sensitive layer constitutes the top-most silver halide emulsion layer.

According to the present invention, the blue sensitive layer has a water swell percentage that is greater than the red sensitive layer or the green sensitive layer. The water swell percentage of a layer is defined as $$(\Delta D/D)\times 100$$

where D represent the dry thickness of the layer, and $\Delta D$ represents the increase in thickness due to water swelling over the dry thickness of the layer. The swelling of the layer can be measured, for example, by dipping the silver halide photographic materials in distilled water at 20° C. for 5 minutes. The water swell percentage of all the light sensitive layers is preferably 250% or less, most preferably from 50 to 200%. If the water swell percentage exceeds 250%, the wet mechanical strength becomes significandy reduced. Also, if the water swell percentage is less than 50%, the developing and fixing speeds are greatly reduced to adversely affect the sensitometric properties.

The water swell percentage of each light sensitive layer, that is, the blue sensitive layer, the green sensitive layer, and the red sensitive layer can be determined by coating each layer separately on a support. The water swell percentage of each light sensitive layer in a multilayer, multicolor photographic element can be determined by using enzyme digesting technique in combination with the swell measurement. The dry film thickness is measured at 20° C. and a controlled humidity of 50%. For each layer thickness, the cross-section of the dried sample is photographed with enlargement by a scanning electron microscope for measurement of the film thickness of each layer.

As used herein, the term "tabular" grain refers to silver halide grains having a thickness of less than 0.3 micrometers (0.5 micrometers for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

Tabularity increases markedly with reductions in tabular grain thickness.

Concerning tabular grains in general, to maximize the advantages of high tabularity it is generally preferred that tabular grains satisfying the stated thickness criterion account for the highest conveniently attainable percentage of the total grain projected area of the emulsion, with at least 25% total grain projected area (% TGPA) being required and 50% TGPA being typical. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069, 5,061,616; 5,219,715; and 5,290,674 incorporated herein by reference.

As noted in the "Summary of the Invention", the ultrathin tabular grain comprise at least 25 weight percent of the total grain content. Ultrathin tabular grains are tabular grains having a thickness of less than 0.07 microns. The ultrathin tabular grains exhibit a desired balance between specularity and reflectivity that is believed to account for the overall advantages realized from the photographic element of the invention. The larger the content of ultrathin tabular grains the more the effect can be taken advantage of. If the ultrathin proportion constitutes at least 50 weight percent and more suitably at least 65 weight percent of the total grains, the desired benefits can be increased. Due to the recognized interchangeability of photographic properties, the advantages of the invention can be realized in speed, silver level, sharpness or graininess. For example, if the silver level is reduced, the reduction in the number of silver centers would be expected to result in a deterioration in the graininess of the image. The results of the invention are an improvement over the expected position.

From the standpoint of imaging silver content, the present invention permits the use of a photographic element having a reduced silver laydown and correspondingly thinner layers. Thus, the laydown of silver halide emulsion in the image-forming layers is such that the total silver in those layers is less than 35 mg/dm$^2$. If desired, the silver level can be reduced to less than 30, less than 25 and even less than 20 mg/dm$^2$. Reductions in silver laydown can also be expressed as reductions in the thickness of the film layers and in the thickness of the overall film. Thus, through the use of ultrathin tabular grains, the total thickness of the photographic element exclusive of the support can be reduced to less than 20, 18, and even less than 15 microns.

The photographic element of the invention is particularly advantageous when employed in films designed for higher speeds such as films designated ISO 100 or faster. Such films employ larger grain sizes and tend therefore to raise more granularity concerns.

The imaging process of the invention includes the steps of exposing the photographic element of the invention to light imagewise and then processing the element with a developer to produce a viewable image.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

Suitable materials for use in the emulsions and elements of this invention are described in *Research Disclosure,* September 1994, Item 36544. The contents of the Research Disclosure, including the patents and publications referenced therein, are incorporated herein by reference, and the Sections hereafter referred to are Sections of the Research Disclosure.

Any suitable hydrophilic polymers can be used as binder to form each light sensitive layer. They include, for example, naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

When gelatin is used as the film forming binder, an inorganic or organic gelatin hardener can be used singly or in combination to control the water swell percentage of each light sensitive layer. Such hardeners have been described in Research Disclosure No. 38957, pages 599–600, Published by Kenneth Mason Publications, Ltd., Dudley Annex, 12 North Street, Emsworth, Hampshire P010 7DQ, ENGLAND, September, 1996. The art has recognized distinct advantages to the utilization of vinylsulfonyl compounds as hardeners for the hydrophilic colloid layers of photographic elements. Such compounds are characterized by the inclusion of a plurality of vinylsulfonyl groups. In perhaps the simplest possible structural form, divinylsulfone, a single sulfonyl group joins two vinyl groups. Most typically a plurality of vinylsulfonylalkyl groups, such as vinylsulfonylmethyl, ethyl, propyl or butyl groups, are joined through an intermediate ether, amine, diamine or hydrocarbon linkage. Bis(vinylsulfonyl) ethers such as bis(vinylsulfonylmethyl) and bis (vinylsulfonylethyl) ethers, N, N-methylene-bis((â-vinylsulfonyl) propionamide) have been found particularly suitable for use as hardeners. Representative vinylsulfonyl hardeners as well as procedures for their synthesis and use are disclosed in Burness et al. U.S. Pat. Nos. 3,490,911, issued Jan. 20, 1970; 3,539,644, issued Nov. 10, 1970, and 3,642,486, issued Feb. 15, 1972, the disclosures of which are incorporated by reference. Other ways to control the water swell percentage of each light sensitive layer are to place a different amount of hardener in each light sensitive layer, or to use a hydrophilic polymer in a particular layer to increase its swelling rate, or to use layer selective-hardening technology by placing in a particular layer a polymeric hardener, or a hardener reactive polymer, or a modified gelatin such as an amine-derivatized gelatin, and the like.

The ultrathin tabular grains employed in the photographic elements of this invention can be used together with other types of silver halide emulsion which include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIAR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, the dye-image-providing material can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The photographic element of the present invention can contain at least one electrically conductive layer, which can be either a surface protective layer or a sub layer. The surface resistivity of at least one side of the support is preferably less than $1\times10^{12}$ Ω/□ more preferably less than $1\times10^{11}$ Ω/□ at 20° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The photographic elements of the invention can be prepared by any of a number of well-know coating techniques, such as dip coating, rod coating, blade coating, air knife coating, gravure coating and reverse roll coating, extrusion coating, slide coating, curtain coating, and the like. Known coating and drying methods are described in further detail in Research Disclosure No. 308119, Published Dec. 1989, pages 1007 to 1008.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The present invention will now be described in detail with reference to examples; however, the present invention should not limited by these examples.

Multilayer photographic elements are constructed on a cellulose acetate support in the following layer order. "Lippmann" refers to an unsensitized fine grain silver bromide emulsion of 0.05 micron diameter. "ECD" or "equivalent circular diameter" is employed to indicate the diameter of a circle having the same projected area as a silver halide grain. t is the thickness of a tabular grain.

| | | | |
|---|---|---|---|
| Layer 1: | 13.45 | mg/dm$^2$ | gelatin |
| | 1.29 | | black filamentary silver |
| | 0.75 | | UV absorber (Dye-2) |
| | 0.29 | | cyan pre-formed dye (Dye-10) |
| | 0.16 | | magenta pre-formed dye (Dye-5) |
| | 1.25 | | yellow-colored magenta dye former (Dye-12) |
| | 0.16 | | yellow tint (Dye-3) |
| | 0.07 | | soluble red filter dye (Dye-6) |
| Layer 2: | 5.38 | mg/dm$^2$ | gelatin |
| | 0.54 | | Dox scavenger (OxDS-2) |
| | 0.21 | | Gelatin thickener |
| Layer 3: | 20.98 | mg/dm$^2$ | gelatin |
| | 2.37 | | slow-slow-cyan silver t: 0.084 μm; ECD: 0.38 μm |
| | 0.64 | | slow-cyan silver t: 0.12 μm; ECD: 0.54 μm |
| | 3.22 | | mid-cyan silver t: 0.054 μm; ECD: 0.934 μm |
| | 7.10 | | cyan dye former (C-1) |
| | 0.54 | | cyan dye forming bleach accelerator (B-1) |
| | 0.21 | | cyan dye forming image modifier (DIR-6) |
| | 0.43 | | cyan dye forming image modifier (DIR-7) |
| | 0.19 | | magenta colored cyan dye forming masking coupler (MC-1) |
| Layer 4: | 13.99 | mg/dm$^2$ | gelatin |
| | 3.01 | | fast cyan silver t: 0.05 μm; ECD: 1.76 μm |
| | 1.61 | | cyan dye former (C-1) |
| | 0.11 | | cyan dye forming image modifier (DIR-6) |
| | 0.43 | | cyan dye forming image modifier (DIR-7) |
| | 0.32 | | magenta colored cyan dye forming masking coupler (MC-1) |
| Layer 5: | 5.38 | mg/dm$^2$ | gelatin |
| | 0.54 | | Dox scavenger (OxDS-2) |
| | 0.21 | | Gelatin thickener |
| Layer 1 to 5 are coated together as the cyan dye image-forming layer | | | |
| Layer 6: | 11.84 | mg/dm$^2$ | gelatin |
| | 1.29 | | slow-slow magenta silver t: 0.084 μm; ECD: 0.38 μm |
| | 0.38 | | slow magenta silver t: 0.091 μm; ECD: 0.65 μm |
| | 2.37 | | magenta dye forming coupler (M-2) |
| | 0.21 | | yellow colored magenta dye forming masking coupler (MC-2) |
| | 0.64 | | Gelatin thickener |
| | 0.07 | | soluble green filter dye (Dye-7) |
| Layer 7: | 11.30 | mg/dm$^2$ | gelatin |
| | 2.36 | | mid-magenta silver t: 0.05 μm; ECD: 0.807 μm |
| | 1.29 | | magenta dye forming coupler (M-2) |
| | 0.64 | | yellow colored magenta dye forming masking coupler (MC-2) |
| | 0.05 | | magenta image modifier (DIR-2) |
| | 0.22 | | cyan dye forming image modifier (DIR-6) |
| | 0.11 | | Gelatin thickener |
| Layer 8: | 11.30 | mg/dm$^2$ | gelatin |
| | 3.12 | | fast magenta silver t: 0.05 μm; ECD 1.76 μm |
| | 0.97 | | magenta dye forming coupler (M-2) |
| | 0.03 | | magenta image modifier (DIR-2) |
| | 0.40 | | Gelatin thickener |
| Layer 9: | 5.38 | mg/dm$^2$ | gelatin |
| | 0.54 | | Dox scavenger (OxDS-2) |
| Layer 6 to 9 are coated as the magenta dye image-forming layer | | | |
| Layer 10: | 15.60 | mg/dm$^2$ | gelatin |
| | 1.61 | | slow-slow-yellow silver t: 0.084 μm; ECD: 0.38 μm |
| | 0.86 | | slow-yellow silver t: 0.05 μm; ECD: 1.19 μm |
| | 0.43 | | mid-yellow silver t: 0.05 μm; ECD: 1.94 μm |
| | 9.04 | | yellow dye forming coupler (Y-4) |
| | 0.16 | | yellow dye forming image modifier (DIR-8) |
| | 0.05 | | cyan dye forming bleach accelerator (B-1) |
| | 0.40 | | Gelatin thickener |

-continued

| | | |
|---|---|---|
| Layer 11: | 10.77 mg/dm$^2$ | gelatin |
| | 1.61 | slow-fast yellow silver t: 0.065 μm; ECD: 2.41 μm |
| | 1.61 | fast yellow silver t: 0.14 μm, ECD: 2.23 μm |
| | 1.51 | yellow dye forming coupler (Y-1) |
| | 1.51 | yellow dye forming coupler (Y-4) |
| | 0.16 | yellow dye forming image modifier (DIR-8) |
| | 0.05 | cyan dye forming bleach accelerator (B-1) |
| | 0.07 | Gelatin thickener |
| | 0.21 | soluble blue filter dye (Dye-9) |
| Layer 12: | 6.99 mg/dm$^2$ | gelatin |
| | 1.08 | Lippmann silver |
| | 1.08 | UV absorber (Dye-1) |
| | 1.08 | UV absorber (Dye-2) |
| Layer 13: | 8.88 mg/dm$^2$ | gelatin |
| | 1.08 | soluble matte beads |
| | 0.05 | permanent matte beads |
| | 0.364 | lubricants |
| Layer 10 to 13 are coated as the yellow dye image-forming layer | | |

The chemical compositions of the silver halide emulsion particles used in the above multilayer photographic elements are described in detail in U.S. patent application Ser. No. 08/595,612 filed Feb. 2, 1996 incorporated herein by reference.

According to the present invention, the yellow dye image-forming layer has a water swell percentage greater than both magenta dye image-forming layer and cyan dye image-forming layer. The water swell percentage of each light sensitive layer is controlled in the present invention examples by distributing bis(vinyl sulfone) methane hardener between layer 1 which is the bottom layer of cyan dye image-forming layer and layer 10 which is the bottom layer of yellow dye image-forming layer. The speed of the coatings was determined by exposing the coatings to white light at 5500K using a carefully calibrated graduated density test object. Exposure time was 0.02 sec. The exposed coating was then developed for 195 sec at 38° C. using the known C41 color process as described, for example, in *The British Journal of Photographic Annual* 1988, pp196–198. The developed silver was removed in the 240 sec bleaching treatment, washed for 180 sec, and the residual silver salts were removed from the coating by a treatment 240 sec in the fixing bath. The Status M densities of the processed strips are read and used to generate a characteristic curve (Density versus Log H). The ISO speed is then calculated using equations described in ISO 5800-1979(E). Significant speed gain is found for the photographic element prepared in accordance with the present invention.

Two strips of each photographic element prepared, 35 mm×305 mm, are then exposed in a manner similar to that described in International Standard ISO 5800, "Photography Color negative film for still photography—Determination of ISO speed" and processed, The resulting 21 step tablet exposures are read using Status M filters, again in a manner similar to that described in International Standard ISO 5800. The density values of the individual steps in the stepped exposure are recorded. Step 1 is the lowest film transmission density, step 21 is the highest film transmission density. The average density of steps 15 through 20 for red, green and blue transmission density are calculated. The average density change for red, green, and blue light sensitive layers is reported in reference to the average density values found for Comparative Example 1. Significant gains in density for each light sensitive layer are found for the photographic element prepared in accordance with the present invention.

TABLE 1

| | Water swell percentage | | | Average density change | | ISO Speed |
|---|---|---|---|---|---|---|
| Photographic element | Blue | Green | Red | Green | Red | Blue |
| Example 1 (Comparison) | 133% | 160% | 165% | — | — | 312 |
| Example 2 (Invention) | 190% | 160% | 146% | +0.212 | +0.129 | 316 |
| Example 3 (Invention) | 220% | 175% | 155% | +0.272 | +0.184 | 320 |

The following structures were used in the multilayer examples:

B-1

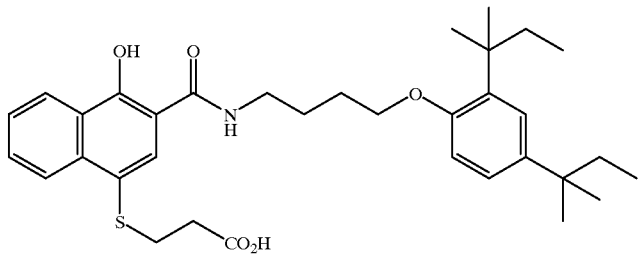

TABLE 1-continued

| Photographic element | Water swell percentage | | | Average density change | | ISO Speed |
|---|---|---|---|---|---|---|
| | Blue | Green | Red | Green | Red | Blue |
| C-1 | | | | | | |
| DIR-2 | | | | | | |
| DIR-6 | | | | | | |

TABLE 1-continued

| Photographic element | Water swell percentage | | | Average density change | | ISO Speed |
|---|---|---|---|---|---|---|
| | Blue | Green | Red | Green | Red | Blue |
| DIR-7 | | | | | | |
| DIR-8 | | | | | | |
| DYE-1 | | | | | | |
| DYE-2 | | | | | | |
| DYE-3 | | | | | | |

TABLE 1-continued

| Photographic element | Water swell percentage | | | Average density change | | ISO Speed |
|---|---|---|---|---|---|---|
| | Blue | Green | Red | Green | Red | Blue |
| DYE-5 | | | | | | |
| DYE-6 | | | | | | |
| DYE-7 | | | | | | |
| DYE-9 | | | | | | |

TABLE 1-continued

| Photographic element | Water swell percentage | | | Average density change | | ISO Speed |
|---|---|---|---|---|---|---|
| | Blue | Green | Red | Green | Red | Blue |
| DYE-10 | | | | | | |
| DYE-11 | | | | | | |
| DYE-12 | | | | | | |

TABLE 1-continued

| Photographic element | Water swell percentage | | | Average density change | | ISO Speed |
|---|---|---|---|---|---|---|
| | Blue | Green | Red | Green | Red | Blue |
| M-2 | | | | | | |
| MC-1 | | | | | | |
| MC-2 | | | | | | |

TABLE 1-continued

| Photographic element | Water swell percentage | | | Average density change | | ISO Speed |
|---|---|---|---|---|---|---|
| | Blue | Green | Red | Green | Red | Blue |
| OxDS-2 | | | | | | |
| Y-1 | | | | | | |
| Y-4 | | | | | | |

The invention has been described in detail with particular reference to certain preferred embodiments thereof, but it will be understood that variations and modifications can be effected within the spirit and scope of the invention.

What is claimed is:

1. A photographic element comprising:

a support; and a plurality of dye-forming hydrophilic colloid containing silver halide emulsion layers which are spectrally sensitized to different regions of the visible spectrum including at least one blue-sensitive emulsion layer, at least one green-sensitive emulsion layer, and at least one red-sensitive emulsion layer wherein each of the silver halide emulsion layers comprises imaging silver having at least 25 weight percent ultrathin tabular grains having a thickness of less than 0.07 microns, and wherein one of the silver halide emulsion layers comprises a topmost silver halide emulsion layer having a water swell percentage which is greater than any other light-sensitive emulsion layer.

2. The photographic element of claim 1 further comprising:

a protective overcoat superposed on the topmost silver halide emulsion layer.

3. The photographic element of claim 1 further comprising:

a filter layer superposed on the support.

4. The photographic element of claim 1 further comprising:

a subbing layer superposed on the support.

5. The photographic element of claim 1 further comprising:

a transparent magnetic recording layer superposed on the support.

6. The photographic element of claim 1 further comprising:

an antistatic layer superposed on the support.

7. The photographic element of claim 1 wherein the support is selected from the group consisting of cellulose nitrate film, cellulose acetate film, poly(vinyl acetal) film, polystyrene film, polycarbonate film, poly(ethylene terephthalate) film, poly(ethylene naphthalate) film, glass, metal plate, paper, polymer and coated paper.

8. The photographic element of claim 1 wherein the blue-sensitive emulsion layer is the topmost silver halide emulsion layer.

9. The photographic element of claim 1 further comprising a vinyl sulfone compound as a hardener.

* * * * *